US008251757B1

(12) United States Patent
Sun et al.

(10) Patent No.: US 8,251,757 B1
(45) Date of Patent: Aug. 28, 2012

(54) CABLE CLAMP HAVING A BASE WITH A TAPERED HOLE AND A SLEEVE WITH A TAPERED OUTER WALL TO CLAMP A CABLE IN-BETWEEN

(75) Inventors: Zheng-Heng Sun, Tu-Cheng (TW); Xiao-Feng Ma, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/050,961

(22) Filed: Mar. 18, 2011

(30) Foreign Application Priority Data

Feb. 25, 2011 (CN) ..... 2011 1 045737

(51) Int. Cl.
*H01R 4/50* (2006.01)
*H01R 4/52* (2006.01)

(52) U.S. Cl. ..... 439/836; 439/783

(58) Field of Classification Search ..... 439/783, 439/836, 863–864, 761
See application file for complete search history.

(56) References Cited

U.S. PATENT DOCUMENTS

| | | | | | |
|---|---|---|---|---|---|
| 4,507,008 | A * | 3/1985 | Adl et al. | ..... | 403/275 |
| 4,787,592 | A * | 11/1988 | Aoshika | ..... | 248/327 |
| 5,145,420 | A * | 9/1992 | Counsel et al. | ..... | 439/783 |
| 5,281,173 | A * | 1/1994 | Cherry et al. | ..... | 439/783 |
| 5,595,511 | A * | 1/1997 | Okada | ..... | 439/762 |
| 6,004,165 | A * | 12/1999 | Dinh et al. | ..... | 439/783 |
| 7,736,203 | B2 * | 6/2010 | Copper et al. | ..... | 439/836 |

* cited by examiner

*Primary Examiner* — Chandrika Prasad
(74) *Attorney, Agent, or Firm* — Altis Law Group, Inc.

(57) ABSTRACT

A clamp includes a main shaft, a clamping sleeve, an elastic element, and a securing cap. The main shaft includes a base portion and a guide bar. The base portion includes a first end surface, and a second end surface. The base portion defines a first receiving hole in the second end surface. The guide bar extends from the base portion. The clamping sleeve is arranged around the guide bar, and includes an outer sidewall for allowing a cable to wind. The elastic element is arranged around the guide bar. The securing cap is threadedly engaged with the guide bar, and the securing cap configured for rotatably operated to press the elastic element toward the clamping sleeve, such that the elastic element pushes the clamping sleeve against the base portion to clamp the cable between the outer sidewall and an inner sidewall of the base portion.

12 Claims, 5 Drawing Sheets

CABLE CLAMP HAVING A BASE WITH A TAPERED HOLE AND A SLEEVE WITH A TAPERED OUTER WALL TO CLAMP A CABLE IN-BETWEEN

BACKGROUND

1. Technical Field

The disclosure generally relates to cable clamps and, particularly, to a cable clamp for securing a cable to a power sourcing equipment.

2. Description of Related Art

Clamps are commonly used in power sourcing equipments for reliably clamping cables. A commonly used cable clamp 10 is shown in FIG. 1 and FIG. 2. The cable clamp 10 generally includes a fixing plate 11, a fastener 13, and a threaded retainer 15. The fastener 13 includes a fastener head 130 and a fastener shaft 132 integrally connected to the fastener head 130. The fastener shaft 132 defines outer threads 1320 in an outer surface thereof. The threaded retainer 15 defines inner threads 150. A central portion of the fixing plate 11 defines a through hole 110. As shown in FIG. 2, in use, a cable 17 is wound around the outer threads 1320 of the fastener shaft 132 and knotted, then the fastener shaft 132 is received into the through hole 110 of the fixing plate 11 and sequentially into the threaded retainer 15. The fastener 13 is rotated relatively to the threaded retainer 15, such that the outer threads 1320 of the fastener shaft 132 can engage the inner threads 150 of the threaded retainer 15. During rotation of the fastener 13, the cable 17 is further wound around the outer threads 1320 of the fastener shaft 132 and finally secured between the fastener head 130 and the fixing plate 11.

One drawback of the cable clamp 10 is difficulty in manual operation, since generally two operators must cooperatively operate the clamp 10. In particular, operation of the clamp 10 is accomplished by rotating the fastener 13 to wind the cable 17 around the fastener shaft 132, wherein the threaded retainer 15 must be fixed when the fastener 13 is rotated to avoid the threaded retainer 15 and the fastener 13 rotating simultaneously and the fastener 13 is not effectively threaded on the threaded retainer 15.

Therefore, what is needed, is a clamp, which can overcome the limitations described.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure.

DETAILED DESCRIPTION

Embodiments of the clamp will now be described in detail below and with reference to the drawings.

Figure 1:
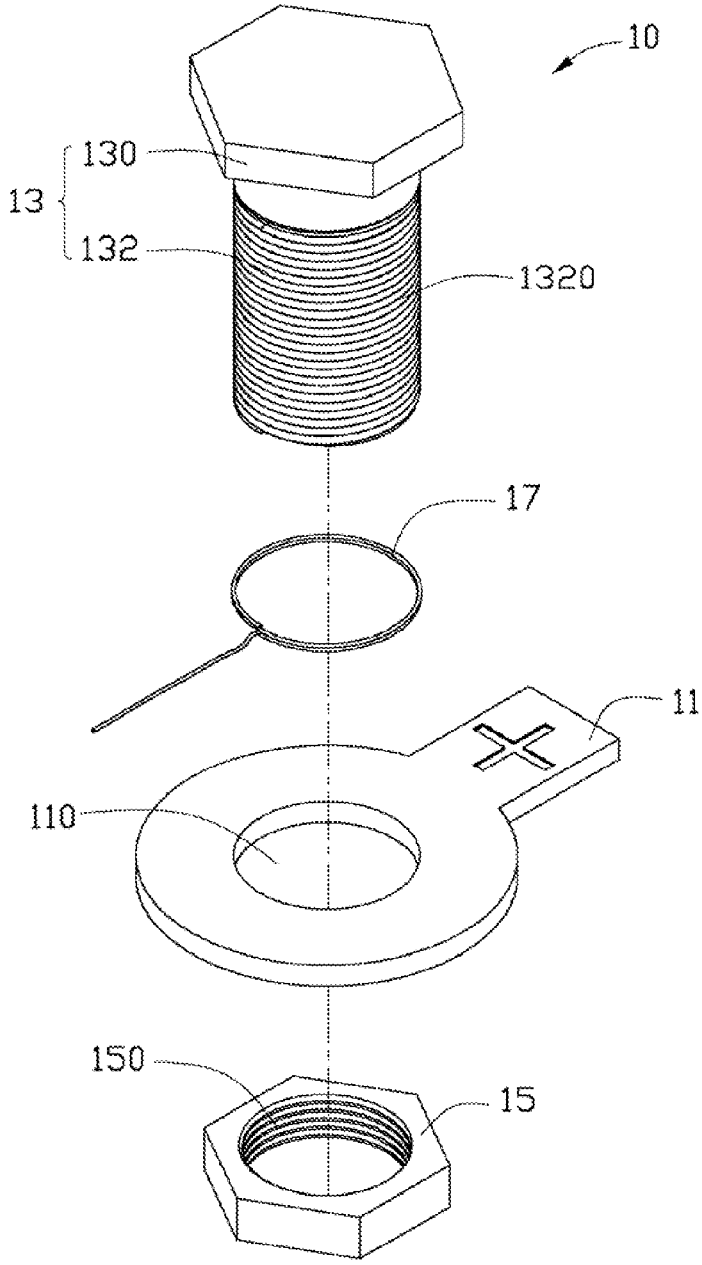
FIG. 1 (RELATED ART)
FIG. 1 is a disassembled and isometric view of a commonly used cable clamp.
Figure 2:
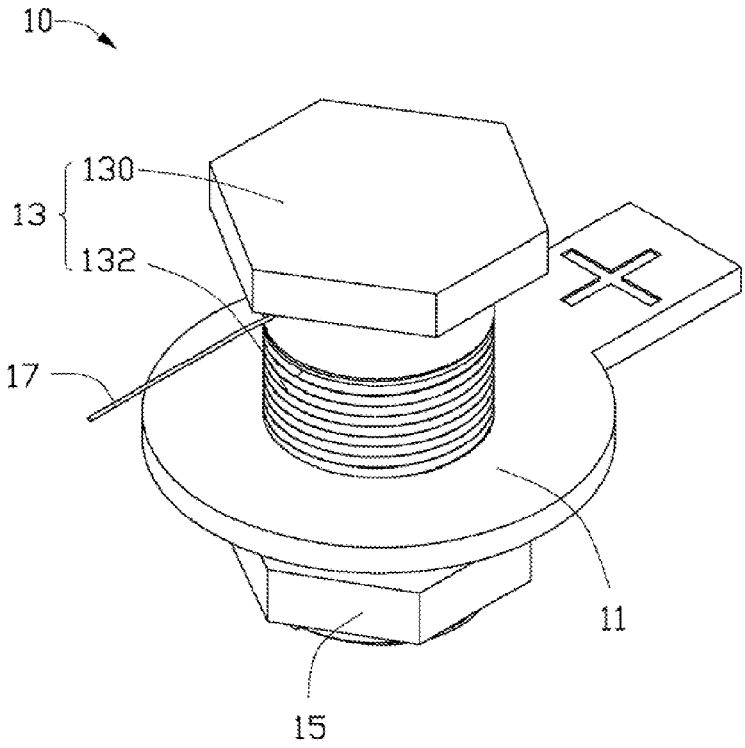
FIG. 2 (RELATED ART)
FIG. 2 is an assembled view of the clamp of FIG. 1.
Figure 3:
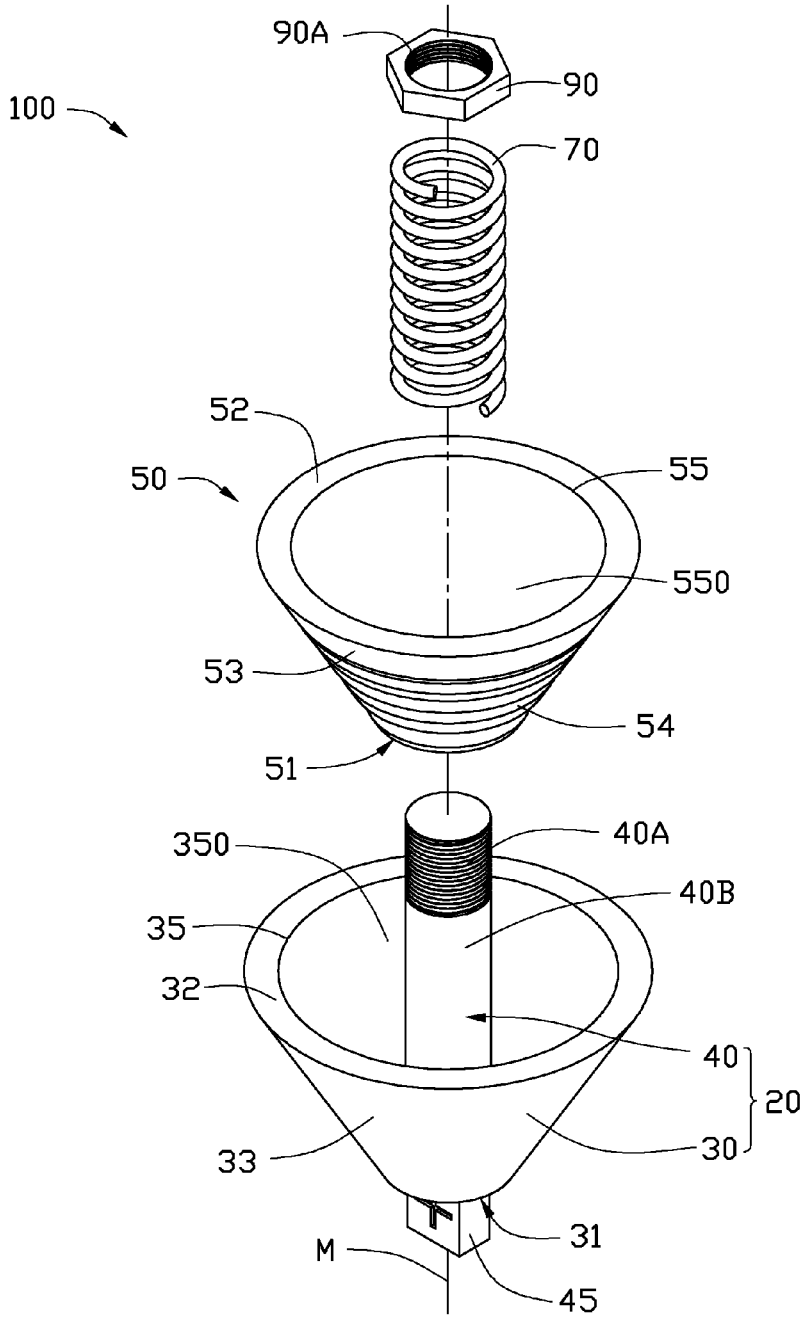
FIG. 3 is a disassembled and isometric view of a clamp, in accordance with one embodiment.
Figure 4:
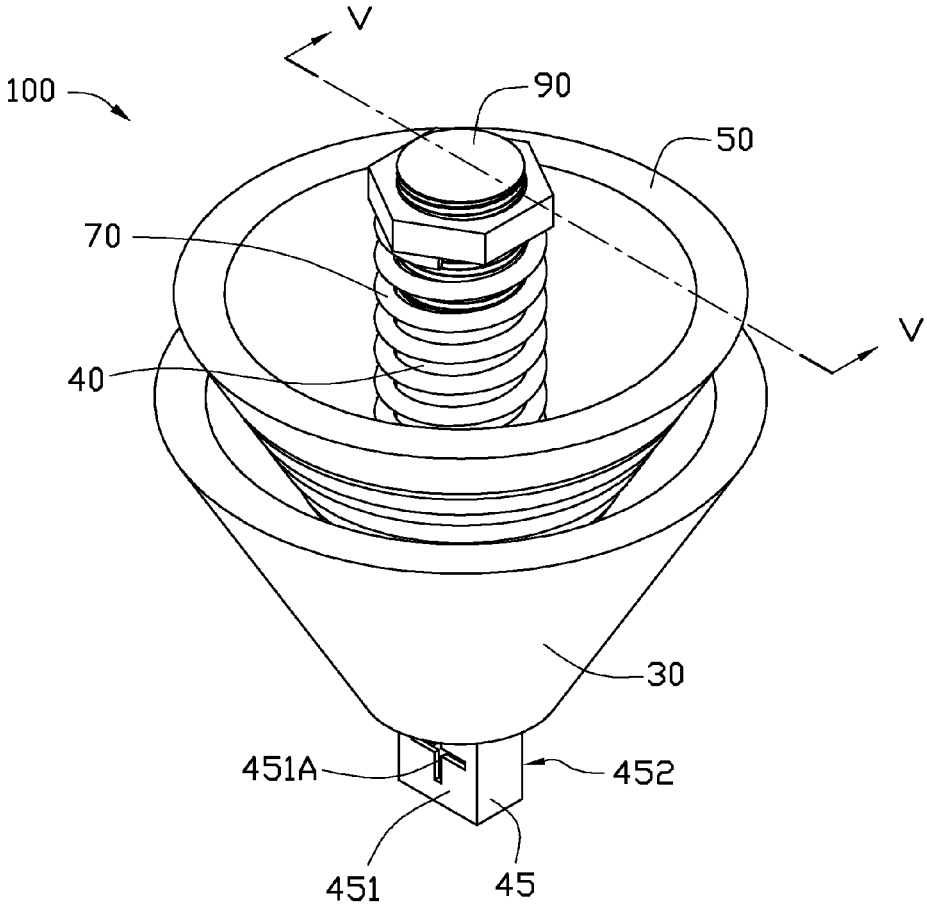
FIG. 4 is an assembled view of the clamp of FIG. 3.

Referring to FIG. 3 and FIG. 4, a clamp 100 in accordance with one embodiment is shown. The clamp 100 includes a main shaft 20, a clamping sleeve 50, an elastic element 70, and a securing cap 90.

The main shaft 20 includes a base portion 30 and a guide bar 40. The base portion 30 has a generally frusto-conical shape, and a central axis M thereof. In this embodiment, the base portion 30 includes a first end surface 31 and a second end surface 32 at opposite ends thereof, as well as a peripheral surface 33. The peripheral surface 33 is located between and adjoins the first and the second end surfaces 31 and 32. The base portion 30 tapers from the second end surface 32 toward the first end surface 32. That is, a diameter of the base portion 30 measured in the peripheral surface 33 decreases from the second end surface 32 toward the first end surface 31.

The base portion 30 has a first receiving hole 35 defined in the second end surface 32. The first receiving hole 35 is generally frusto-conical, and tapers toward the first end surface 31. That is, a diameter of the base portion 30 measured in the first receiving hole 35 decreases from the second end surface 32 toward the first end surface 31. In this embodiment, the first receiving hole 35 extends toward the first end surface 31 but not through the first end surface 31. The base portion 30 has an inner sidewall 350 in the first receiving hole 35. The inner sidewall 350 adjoins the second end surface 32.

The guide bar 40 extends from the inner sidewall 350 of the base portion 30 and away from the first end surface 31. In this embodiment, the guide bar 40 extends along the central axis M of the base portion 30 and, has a threaded end 40A away from the first end surface 31. In addition, the guide bar 40 has a smooth outer surface 40B located between the threaded end 40A and the inner sidewall 350.

The clamping sleeve 50 also has a generally frusto-conical shape, and includes a third end surface 51 and a fourth end surface 52 at opposite ends thereof, as well as an outer sidewall 53 between and adjoining the third end surface 51 and the fourth end surface 52. In addition, the clamping sleeve 50 tapers from the fourth end surface 52 toward the third end surface 51. That is, a diameter of the clamping sleeve 50 measured in the outer sidewall 53 decreases from the fourth end surface 52 toward the third end surface 51. Moreover, the clamping sleeve 50 has a number of concentric circular slots 54 defined in the outer sidewall 53. In this embodiment, the circular slots 54 are spaced from one another and arranged from the third end surface 51 toward the fourth end surface 52. Each of the circular slots 54 is curved. In this embodiment, a traverse section of the clamping sleeve 50 across the central axis M of the base portion 30 has a number of curves 540 in the respective circular slots 54 (see FIG. 5). In addition, a radius of each slot 54 decreases with increasing distance of the circular slots 54 relative to the third end surface 51 (or the first end surface 31). A depth of each slot 54 also decreases with increasing distance of the circular slots 54 relative to the third end surface 51 (or the first end surface 31).

The clamping sleeve 50 has a second receiving hole 55 defined in the fourth end surface 52. The second receiving hole 55 is generally frusto-conical, and tapers toward the third end surface 31. That is, a diameter of the clamping sleeve 50 measured in the second receiving hole 55 decreases from the fourth end surface 52 toward the third end surface 51. In this embodiment, the second receiving hole 55 extends through the third end surface 51. The second receiving hole 55 has a minimal diameter at the third end surface 51, and the minimal diameter equals a diameter of the guide bar 40.

The main shaft 20 and the clamping sleeve 50 both can be made of conductive material such as iron, aluminum, silver, or alloy thereof. Alternatively, the main shaft 20 and the clamping sleeve 50 both can be made of another suitable conductive material, such as copper.

The elastic element 70 can be a spring, such as a compression spring. The securing cap 90, in this embodiment, is in the form of a threaded retainer. That is, the securing cap 90 has interior threads 90A defined therein.

In assembly, the clamping sleeve 50 is moved toward the base portion 30, with the fourth end surface 52 facing away from the second end surface 32 of the base portion 30. The guide bar 40 is coaxially aligned with the second receiving hole 55 during movement of the clamping sleeve 50, such that the movement of the clamping sleeve 50 is guided by the guide bar 40, and thus the guide bar 40 can be received in the second receiving hole 55. Then the elastic element 70 and the securing cap 90 are arranged around the guide bar 40 in sequence. Subsequently, the securing cap 90 is rotated relative to the guide bar 40 to engage the interior threads 90A of the securing cap 90 with the threaded end 40A of the guide bar 40, and thus simultaneously the securing cap 90 is impelled toward the inner surface 550 of the clamping sleeve 50. The securing cap 90 compresses the elastic element 70 toward the clamping sleeve 50, such that clamping sleeve 50 abuts the base portion 30.

Figure 5:
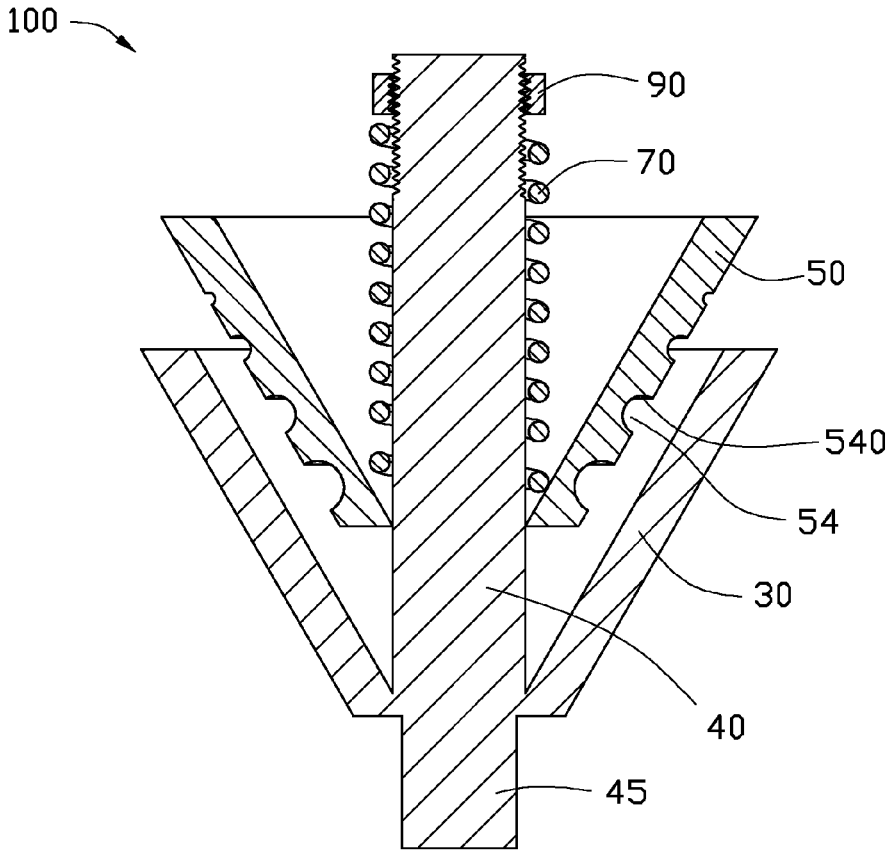
FIG. 5 is a sectional view of the clamp of FIG. 4, taken along line V-V.

As shown in FIG. 4 and FIG. 5, a cable can be wound in the circular slots 54. In this embodiment, in operation, the base portion 30 can be previously fixed to conventional devices, such as power sourcing equipment. The clamping sleeve 50 can be withdrawn from the base portion 30, and the elastic element 70 compressed until at least one or more circular slots 54 are exposed outside the first receiving hole 35, such that the cable can be wound in the circular slots 54. Subsequently, the clamping sleeve 50 can be released, whereby the elastic element 70 compresses the clamping sleeve 50 toward the base portion 30. The cable is accordingly, clamped firmly between outer sidewall 53 of the clamping sleeve 50 and the inner sidewall 350 of the base portion 30.

In an alternative embodiment, the cable can be clamped firmly between the outer sidewall 53 of the clamping sleeve 50 and the inner sidewall 350 of the base portion 30 without the circular slots 54 defined in outer sidewall 53 of the clamping sleeve 50.

In this embodiment, the base portion 30 and the clamping sleeve 50 can be used to conduct electricity. In one typical example, a plastic cover at an end of the cable can be removed to expose a metallic wire of the cable. In winding the cable, only the remaining portion of the cable having the plastic cover is wound in at least one or more circular slots 54 while the end portion of the cable without the plastic cover is exposed exterior to the circular slots 54. When the cable is clamped between the outer sidewall 53 of the clamping sleeve 50 and the inner sidewall 350 of the base portion 30, the metallic wire of the end portion of the cable contacts both the base portion 30 and the clamping sleeve 50. In this manner, the cable is electrically connected to the base portion 30 and the clamping sleeve 50.

In this embodiment, the main shaft 20 may further include a conducting bar 45. The conducting bar 45 extending from the first end surface 31 of the base portion 30 away from the second end surface 32. In this embodiment, the conducting bar 45, the base portion 30, and the guide bar 40 are made of copper and integrally connected to one another. The conducting bar 45 is connected to a power supply providing electric current to the cable via the conducting bar 45, the base portion 30 and the clamping sleeve 50.

As shown in FIG. 4, in this embodiment, the conducting bar 45 is generally cuboid and includes a first conductive surface 451 and a second conductive surface 452 at opposite sides thereof. Each of the first and the second conductive surfaces 451 and 452 is generally perpendicular to the first end surface 31 of the base portion 30. In addition, the conducting bar 45 has a cross-shaped slot 451A defined in the first conductive surface 451 and a longitudinal slot (not visible) defined in the second conductive surface 452. The shapes of slots are easily recognized such that an anode or a cathode of the power supply can be appropriately connected to the corresponding first conducting surface 451 or second conducting surface 452. In this embodiment, the first conducting surface 451 with the cross-shaped slot 451A connects to the anode of the power supply, and the second conducting surface 452 with the longitudinal slot connects to the cathode of the power supply.

It is understood that the described embodiments are intended to illustrate rather than limit the disclosure. Variations may be made to the embodiment without departing from the spirit of the disclosure. Accordingly, it is appropriate that the appended claims be construed broadly and in a manner consistent with the scope of the disclosure.

What is claimed is:

1. A clamp comprising:

a main shaft comprising:

a base portion comprising a first end surface and a second end surface at opposite ends thereof, the base portion defining a first receiving hole, the first receiving hole tapering from the second end surface toward the first end surface, and a guide bar extending from an inner sidewall of the base portion in the first receiving hole away from the first end surface;

a clamping sleeve arranged around the guide bar, the clamping sleeve comprising an outer sidewall tapering away from the first end surface, the outer sidewall being configured for allowing a cable to wind;

an elastic element arranged around the guide bar; and a securing cap threadedly coupled to the guide bar, the securing cap configured for being rotatably operated to press the elastic element toward the clamping sleeve, such that the elastic element pushes the clamping sleeve against the base portion to clamp the cable between the outer sidewall of the clamping sleeve and the inner sidewall of the base portion.

2. The clamp of claim 1, wherein the clamping sleeve has a generally frusto-conical shape.

3. The clamp of claim 2, wherein the base portion has a generally frusto-conical shape, and the base portion tapers from the second end surface toward the first end surface.

4. The clamp of claim 1, wherein the clamping sleeve has a plurality of concentric circular slots defined in the outer sidewall of the base portion.

5. The clamp of claim 4, wherein the circular slots are spaced from one another and located between the second end surface and the first end surface.

6. The clamp of claim 5, wherein a depth of each circular slot decreases with distance of the circular slots relative to the first end surface increasing.

7. The clamp of claim 6, wherein each of the circular slots is curved.

8. The clamp of claim 7, wherein a radius of each circular slot decreases with distance of the circular slots relative to the first end surface increasing.

9. The clamp of claim 1, wherein the clamping sleeve defines a second receiving hole, the guide bar of the main shaft extends through the second receiving hole, the elastic element is located between the securing cap and an inner surface of the clamping sleeve in the second receiving hole.

10. The clamp of claim 9, wherein the clamping sleeve comprises a third end surface and a fourth end surface at opposite ends thereof, the outer sidewall connects to the third end surface and the fourth end surface, the third end surface is adjacent to the first end surface, the second receiving hole is generally frusto-conical, the second receiving hole tapers from the fourth end surface toward the third end surface, a minimal diameter of the second receiving hole is equal to a diameter of the guide bar.

11. The clamp of claim 1, wherein the main shaft further comprises a conducting bar, the conducting bar extends from the first end surface away from the second end surface, and the conducting bar comprises a first conductive surface and a second conductive surface at opposite sides thereof.

12. The clamp of claim 1, wherein each of the main shaft and the clamping sleeve is made of copper.

* * * * *